US006796932B2

(12) United States Patent
Kuge et al.

(10) Patent No.: US 6,796,932 B2
(45) Date of Patent: Sep. 28, 2004

(54) MANUFACTURING METHOD AND APPARATUS OF GUSSET BAG

(75) Inventors: Raizo Kuge, Saitama-Ken (JP); Sho Obara, Saitama-Ken (JP)

(73) Assignee: Hosokawa Yoko Co., Ltd., Tokyo-to (JP)

( * ) Notice: Subject to any disclaimer, the term of this patent is extended or adjusted under 35 U.S.C. 154(b) by 0 days.

(21) Appl. No.: 09/829,071

(22) Filed: Apr. 10, 2001

(65) Prior Publication Data

US 2002/0147090 A1 Oct. 10, 2002

(51) Int. Cl.[7] ..... B31B 1/90

(52) U.S. Cl. ..... 493/218; 493/189; 493/198; 493/243; 493/249

(58) Field of Search ..... 493/186, 189, 493/193, 194, 198, 210, 212, 213, 218, 243, 249

(56) References Cited

U.S. PATENT DOCUMENTS

| | | | | | |
|---|---|---|---|---|---|
| 4,526,565 | A | * | 7/1985 | Hummel et al. | 493/196 |
| 4,610,651 | A | * | 9/1986 | Jacobson et al. | 493/212 |
| 4,620,320 | A | * | 10/1986 | Sullivan | 383/203 |
| 4,717,262 | A | | 1/1988 | Roen et al. | |
| 4,913,693 | A | * | 4/1990 | Ball et al. | 493/194 |
| 5,147,272 | A | * | 9/1992 | Richison et al. | 493/195 |
| 5,746,862 | A | | 5/1998 | Derby | |
| 6,068,585 | A | * | 5/2000 | Ouchi | 493/213 |
| 6,423,356 | B2 | * | 7/2002 | Richison et al. | 426/118 |
| 6,425,847 | B1 | * | 7/2002 | Broenstrup | 493/231 |

FOREIGN PATENT DOCUMENTS

| | | |
|---|---|---|
| EP | 1 034 918 A2 | 9/2000 |
| WO | 96/10524 | 4/1996 |

* cited by examiner

*Primary Examiner*—Eugene Kim
*Assistant Examiner*—Christopher R Harmon
(74) *Attorney, Agent, or Firm*—Young & Thompson

(57) ABSTRACT

The present invention provides a manufacturing method and apparatus of a gusset bag, capable of coping with manufacture of various types of gusset bag and permitting improvement of productivity. A pair of flat films 12*a* and 12*b* are separated and transferred by a transfer unit 14, and a side film 15 extending in a direction perpendicular to the transfer direction of the flat films or in the same direction as the flat films and forming side surfaces 2*c* and 2*d* of the bag main body 2 is inserted between the pair of flat films 12*a* and 12*b*. The end of the side film is folded to form an open surface 43 at least at an end of the side film and the flat films. As a result, it is possible: (1) to manufacture a zippered gusset bag by attaching a zipper to the end of each flat film; (2) to manufacture a gusset bag having a flat bottom by attaching a bottom film to the end of each flat film; and (3) to manufacture a zippered gusset bag having a flat bottom by attaching a zipper to one end of each flat film, and a bottom film to the other end thereof.

5 Claims, 13 Drawing Sheets

MANUFACTURING METHOD AND APPARATUS OF GUSSET BAG

BACKGROUND OF THE INVENTION

1. Field of the Invention

The present invention relates to manufacturing method and apparatus of a gusset bag having gores on the both sides of the bag.

2. Description of the Related Art

There is conventionally known a three-side-sealed type flat bag container prepared by placing flat films opposed to each other and heat-sealing three sides thereof. When attaching a zipper to this flat bag container, the transfer direction of flat films composing the flat bag container is caused to coincide with the zipper extending direction to improve productivity.

Also for bags other than flat bags, contrivances are made for attaching a zipper. A gusset bag having gores on the both sides of the bag has a wide range of applications because of an excellent capacity. There is therefore a demand for attaching a zipper to the mouth of the gusset bag.

More recently, there is known a gusset bag having a flattened bottom to improve self-standing property of the gusset bag. This gusset bag is called a flat bottom bag, and manufactured by attaching a bottom film to the bag main body having gores.

However, the manufacturing method of the gusset bag requires forming gores on the sides. If the transfer direction of the flat films forming the front and back surfaces of the gusset bag is caused to coincide with the transfer direction of the side films forming the sides of the gusset bag, these directions are different from the zipper extending direction or the bottom film extending direction, resulting in a problem of a poor productivity. The gusset bags are classified into three kinds: a type having a zipper attached thereto, a type having a flat bottom, and a type having a bottom and a zipper attached thereto. It is necessary to use different manufacturing methods in order to manufacture the individual types, and this has resulted in a poor productivity.

SUMMARY OF THE INVENTION

Accordingly, it is an object of the present invention to provide manufacturing method and apparatus of a gusset bag capable of coping with various types of gusset bags and permitting improvement of productivity.

The present invention will now be described. For the purpose of solving the aforementioned problems, the present inventor inserted a side film extending in a direction perpendicular to the transfer direction of the flat film between a pair of flat films forming the front and back surfaces of the gusset bag, and folded the both ends of the side film so as to facilitate attachment of the zipper or the bottom film. More specifically, a first aspect of the present invention provides a manufacturing method of a gusset bag having front and back surfaces composed of a pair of flat surfaces opposed to each other, and sides composed of pleat-shaped side surfaces connecting the side edges of the both flat surfaces and tucked in the both flat surfaces. The manufacturing method comprises a step of separating and transferring a pair of flat films for forming the pair of flat surfaces of the bag; a step of inserting side films between the pair of flat films and forming the side surfaces of the gusset bag; a step of forming a strip-shaped film by putting the pair of flat films opposed to each other; a step of sealing the flat films and the side films; a step of forming an open surface at least at an end of the side films and the flat films by tucking in the side film at a gore crease from a point on the crease selected as a base point to an end of the side film in a direction counter to the original tucking direction, and tucking in the side film at lines connecting the two corners at ends of the side film or the proximity thereof and the base point in an inward direction of the gusset bag to form a convex edge, thereby forming an open surface at least at an end of each of the side film and the flat film; and a step of cutting the strip-shaped film along a prescribed cutting line.

According to this aspect of the invention, in which the ends of the side film are folded and an open surface is formed at least at an end of the side films and the flat films, it is possible: (1) to manufacture a gusset bag having a zipper by attaching the zipper onto the end of each flat film; (2) to manufacture a gusset bag having a flat bottom by attaching a bottom film onto the end of each flat film; and (3) to manufacture a gusset bag having a zipper and a flat bottom by attaching the zipper onto one end of each flat film and the bottom film onto the other. There are thus available the manufacturing methods capable of coping with the three types of gusset bag, respectively. Because the transfer direction of the flat film is perpendicular to the extending direction of the side film, the transfer direction of the flat film can be caused to coincide with the transfer direction of the zipper or the transfer direction of the bottom film, thus facilitating attachment of the zipper or the bottom film, and permitting improvement of productivity.

A second aspect of the invention provides a manufacturing method of a gusset bag, further comprising a step of attaching a zipper extending in a direction in parallel with the transfer direction of the flat film to the open surface; and a step of sealing together the zipper and the flat film.

According to this aspect of the invention, it is possible to manufacture a gusset bag having a zipper attached thereto. Since the ends of the side film are folded to form an open surface as described above, it is easier to attach the zipper, and the side film reinforced by the open surface becomes harder to be broken.

A third aspect of the invention provides a manufacturing method of a gusset bag, further comprising a step of attaching, to the end of each flat film, a V-shaped bottom film which extends in a direction in parallel with the transfer direction of the flat film and forms a bottom surface of the gusset bag; and a step of sealing together the bottom film and the flat film.

According to this aspect of the invention, a gusset bag with a flat bottom can be manufactured by attaching a V-shaped film to the depth onto the open surface formed by folding the side film as described above, thus permitting improvement of productivity of gusset bags.

A fourth aspect of the invention provides a manufacturing method of a gusset bag, wherein the open surfaces is formed at the both ends of the side film and the flat film; and the strip-shaped film is cut along a prescribed cutting line so as to form gusset bags in two rows to the left and the right.

According to this aspect of the invention, it is possible to manufacture gusset bags in two rows symmetrically to the right and left in the transfer direction of the flat films, thus permitting improvement of the gusset bag.

A fifth aspect of the invention provides a manufacturing method of a gusset bag, wherein the open surface is formed at the both ends of the side film and the flat film; attaching a zipper, to one end of each flat film, extending in a direction in parallel with the transfer direction of the flat film; and attaching, to the other end of each flat film, a V-shaped bottom film which extends in a direction in parallel with the transfer direction of the flat film, and forms a bottom surface of the gusset bag; and a step of sealing together the zipper and the flat film, on the one hand, and the bottom film and the flat film, on the other hand.

According to this aspect of the invention, it is possible to manufacture a zippered gusset bag having a flat bottom, together with the aforementioned advantages.

A sixth aspect of the invention provides a manufacturing method of a gusset bag, wherein the side film forms side surfaces of the gusset bag located in front and back in the transfer direction of the flat film.

According to this aspect of the invention, four side surfaces in total including two rows of left and right side films and front and back side films in each row in the transfer direction are formed. It is thus possible to further improve productivity of gusset bags.

As in any of seventh to ninth aspects of the invention, the side film may be prepared by combining two V-shaped films, or by bending the both sides of a rectangular film so that the both ends of the film are located on the center line of the film, or by crushing a tubular film.

According to tenth aspect of the invention, the side film is composed by combining boat-shaped films prepared by folding a rectangular film at the center line, forming a bottom crease, tucking in the film at the crease from a point on the crease selected as a base point to an end of the film in a direction counter to the original tucking direction, and tucking in the film at lines connecting the two corners at ends of the film or the proximity thereof and the base point in an inward direction of the gusset bag to form a convex edge. In the step of forming the open surface, it is not necessary to fold the side film to form the open surface on the side film.

According to the eleventh aspect of the invention, there is provided a manufacturing apparatus of a gusset bag having front and back surfaces composed of a pair of flat surfaces opposed to each other, and sides composed of pleat-shaped side surfaces connecting the side edges of the both flat surfaces and tucked in the both flat surfaces, comprising a transfer unit for separating and transferring a pair of flat films for forming the pair of flat surfaces of the bag; a side film inserting unit for inserting side films between the pair of flat films so as to extend in a direction perpendicular to the transfer direction of the flat films; a film placing unit for forming a strip-shaped film by placing the pair of flat films opposed to each other; a side film sealing unit for sealing the flat films and the side films; an open surface forming unit for forming an open surface at least at an end of the side films and the flat films by tucking in the side film at the gore crease from a point on the crease selected as a base point to an end of the side film in a direction counter to the original tucking direction, and tucking in the side film at lines connecting the two corners at ends of the side film or the proximity thereof and the base point in an inward direction of the gusset bag to form a convex edge; thereby forming an open surface at least at an end of each of the side film and the flat film; and a cutting unit for cutting the strip-shaped film along a prescribed cutting line, thus solving the aforementioned problems.

According to this aspect of the invention, there is available a manufacturing apparatus of a gusset bag coping with the above-mentioned kinds of gusset bags.

DESCRIPTION OF THE PREFERRED EMBODIMENTS

Figure 1:
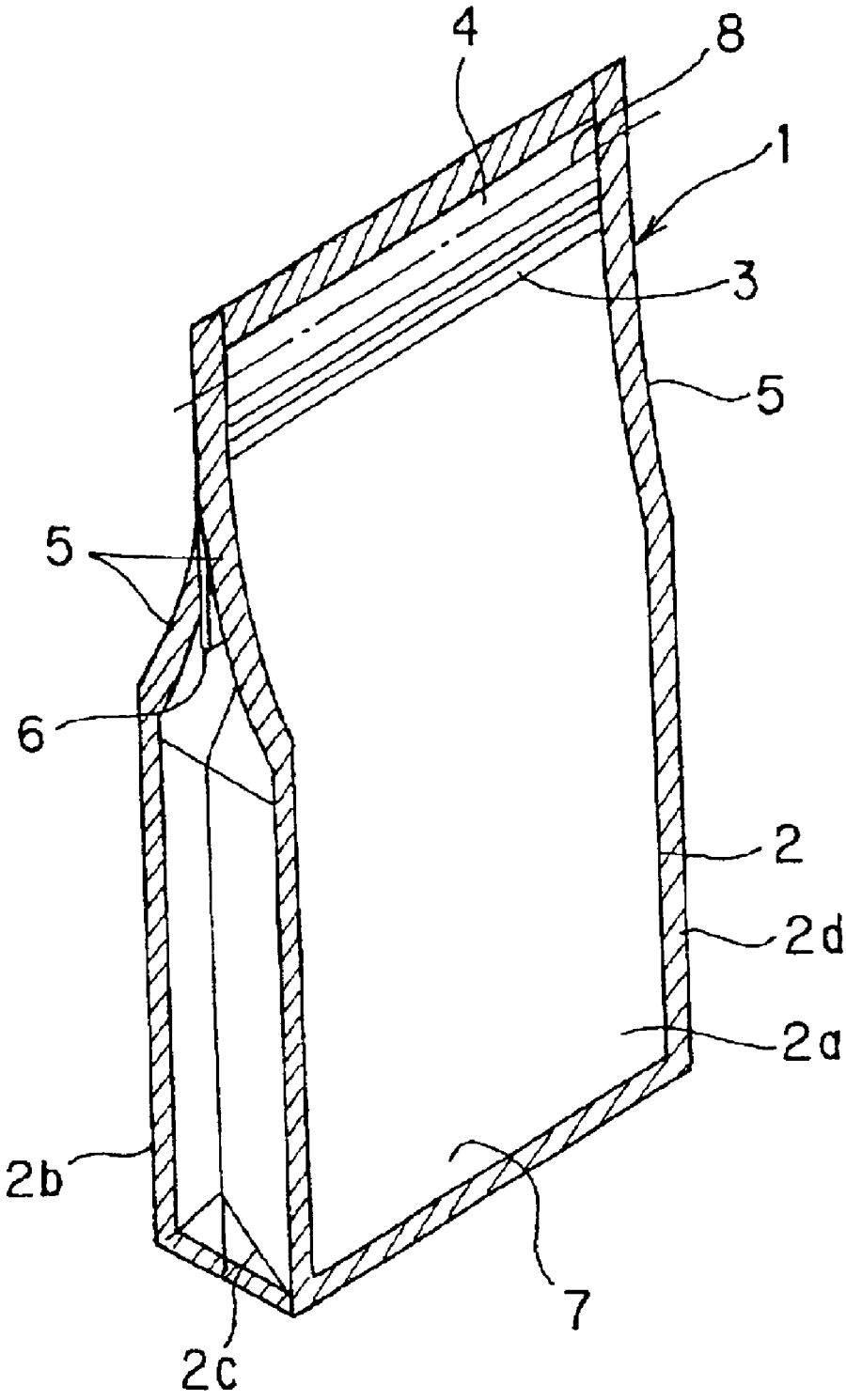
FIG. 1 is a perspective view illustrating a gusset bag manufactured by a manufacturing apparatus for a gusset bag of an embodiment of the present invention.
Figure 2:
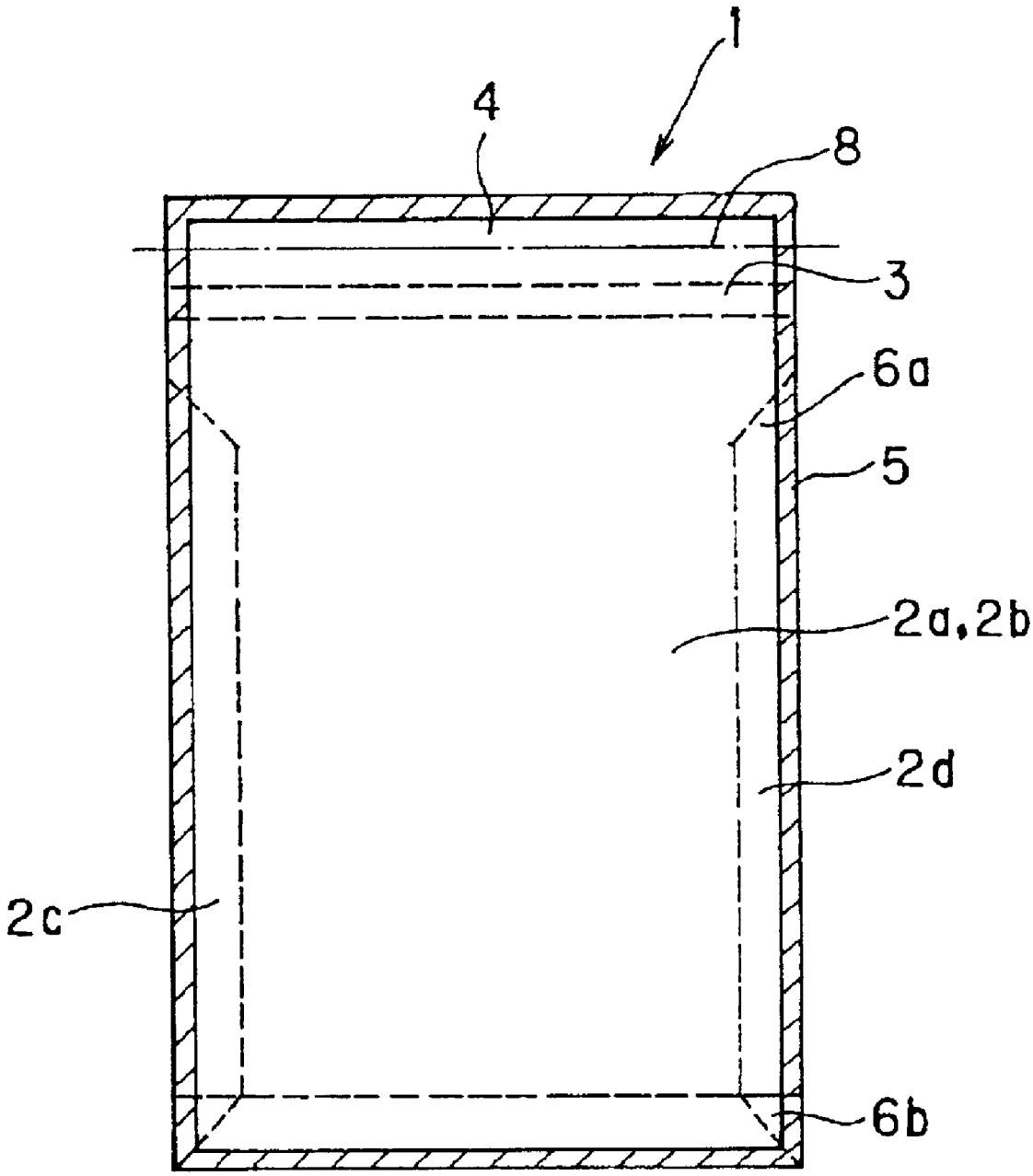
FIG. 2 is a plan view of the gusset bag shown in FIG. 1.

FIGS. 1 and 2 illustrate a zippered gusset bag manufactured by the present invention. FIG. 1 is a perspective view of a state in which a zippered gusset bag is filled with contents; and FIG. 2 is a plan view of a state in which the bag is folded before it is filled with contents. The gusset bag has gores on the sides thereof. Three types of gusset bag are available, including a zippered gusset bag having a zipper attached to the mouth thereof; a flat bottom type gusset bag having a bottom formed flat; and a gusset bag having a zipper attached thereto and a bottom formed flat. The zippered gusset bag having a bottom formed flat will be described here.

The gusset bag 1 has a bag main body 2 having gores on the sides thereof, a zipper 3 permitting opening and closing of a mouth 4 of the bag main body 2, and a flat bottom surface 7. The bag main body 2 is composed of a pair of flat surfaces 2*a* and 2*b* opposite to each other serving as a front surface and a back surface, respectively. The sides are composed of pleat-shaped side surfaces 2*c* and 2*d* formed by connecting the side edges of the flat surfaces 2*a* and 2*b* and tucking in the same inside the flat surfaces 2*a* and 2*b*. The flat surfaces 2*a* and 2*b* and the side surfaces 2*c* and 2*d* comprise separate members connected by sticking to each other. In the bag main body, the flat surfaces 2*a* and 2*b* are stuck to each other at the top portions, and the flat surfaces 2*a* and 2*b* and the side surfaces 2*c* and 2*d* are stuck together on the sides. Fusion-sealed surfaces 5 (hatched portion in FIG. 1) indicate these sticking positions. Each of the side surfaces 2*c* and 2*d* has a side tab 6*a* on the top portion thereof. The side tab 6*a* is formed by folding each of the two side surfaces 2*c* and 2*d* outside at a point on the crease as a base point. This folding step will be described in detail as to the step of forming an open surface. When sealing the sides of the bag main body, the side tabs 6*a* are also sealed. In general, a plastic film, paper, aluminum foil or an appropriate lamination combining them is used as a material for the bag main body 2 and the side surfaces 2*c* and 2*d*, but there is imposed no limitation on the material or the thickness thereof.

The zipper has a strip shape, and is formed by combining a male member and a female member engaging with each other. The male member has a projection at the center thereof. The female member has on the other hand a concave band formed at the center. Engagement of the projection and the concave band ensures sealing of the interior. A perforated line 8 is formed above the zipper 3. When removing the contents, the top end of the mouth 4 is cut off to open the zipper. After removing some of the contents, the zipper is closed to seal the interior. Any of various plastic materials is applicable in general as a material for the zipper 3.

The bottom 7 has a flat rectangular shape, and the four side of the outer periphery are fusion-sealed to the lower end of the bag main body 2. The side films 2*a* and 2*b* have side tabs 6*b* at the lower ends thereof. The side tabs 6*b* are formed by folding outside the two sides 2*c* and 2*d* at a point on the crease as a base point. This folding step will also be described in detail later as to the step of forming the open surface. The bottom 7 is fusion-sealed to this side tabs 6*b*. In FIG. 2 showing the state in which the gusset bag is folded, the bottom is V-shaped.

Figure 3:
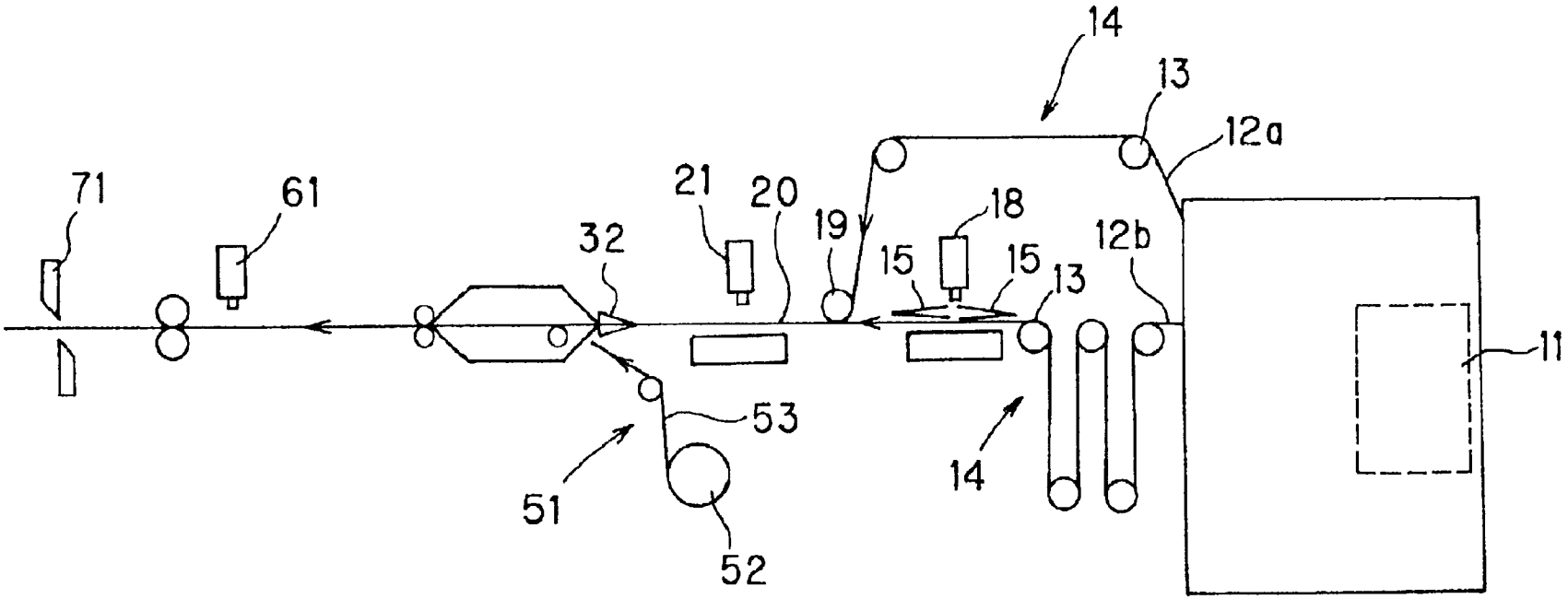
FIG. 3 is a schematic view showing a manufacturing apparatus for a gusset bag of an embodiment of the invention.

FIG. 3 illustrates a manufacturing apparatus of a gusset bag in an embodiment of the invention. Manufacturing method and apparatus of a gusset bag will now be described. First, an example of manufacturing gusset bags in two right and left rows will be described.

A material fed from a material roll 11 is pulled out by a payoff roll, and the material vertical posture is changed by a turn bar into a horizontal posture. The material is cut at the center into two halves which are separated into a pair of upper and lower flat films 12*a* and 12*b*. These flat films 12*a* and 12*b* form flat surfaces 2*a* and 2*b* in two left and right rows of the bag main body 2. In other words, the flat films 12*a* and 12*b* are transferred by a transfer unit 14 composed of a feed roller 13 and the like in such a manner that the flat films 12*a* and 12*b* opposed to each other in a vertical direction form the front surface and the back surface of a bag. The materials are fed continuously. However, the flat films are intermittently sent by a step roller or the like not shown in the subsequent steps, and other operations are carried out during the period when the intermittently sent flat films stop.

Figure 4:
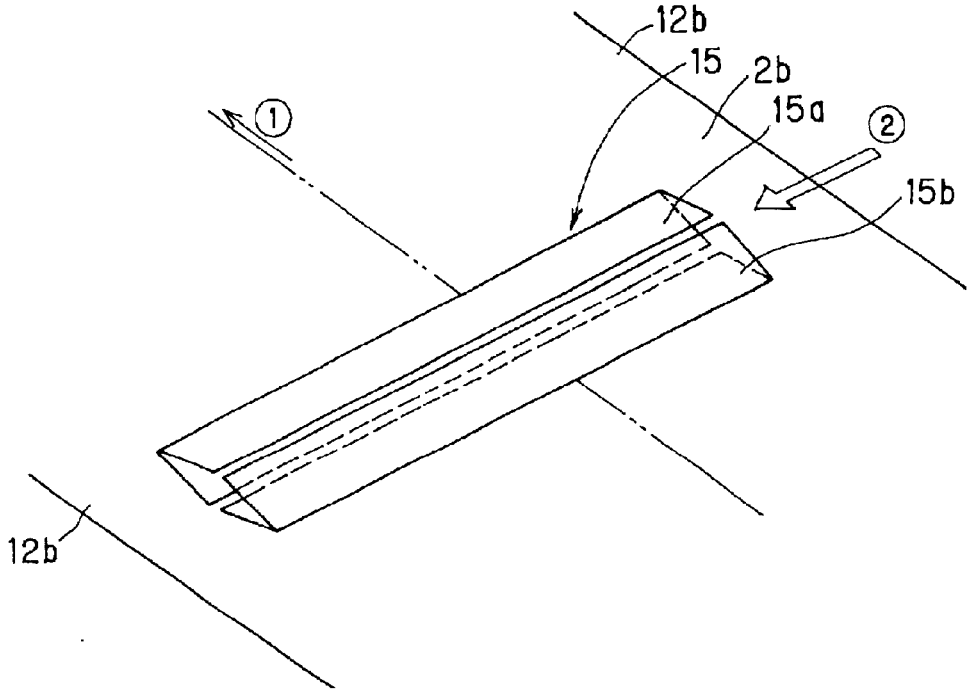
FIG. 4 is a perspective view showing a side film inserted into the flat film.

FIG. 4 shows a side film 15 to be inserted onto the flat film 12*b*. The side film 15 comprising V-shaped films 15*a* and 15*b* opposed to each other is inserted onto the lower flat film 12*b* by a side film inserting unit in a direction perpendicular to the transfer direction of the flat films 12*a* and 12*b* before placing the pair of flat films 12*a* and 12*b* opposed to each other. This side film 15 extends in a direction perpendicular to the transfer direction of the flat films 12*a* and 12*b* and forms the sides 2*c* and 2*d* for two left and right rows of the bag main body 2. The side film 15 forms side surfaces 2*c* and 2*d* located in front and back in the transfer direction. The left side of the V-shaped film 15*a* forms the side surface 2*c* of a bag in the left row, and the right side of the V-shaped film 15*a* forms the side surface 2*c* of a bag in the right row. The left side of the V-shaped film 15*b* forms the side surface 2*d* in the left row of a bag, and the right side of the V-shaped film 15*b* forms the side surface 2*d* in the right row of a bag, the V-shaped films 15*a*, 15*b* are so disposed that their open mouths are opposed to each other. That is, the side film 15 forms four side surfaces 2*c* and 2*d* in total for one side of each of four bags adjacent each other, in the right and left rows, in the transfer direction. The side film 15 is inserted onto the flat film 12*b* forming two right and left rows of flat surfaces in a direction (direction 2) in FIG. 4) perpendicular to the transfer direction (direction 1) in FIG. 4) of the flat film.

Figure 5:
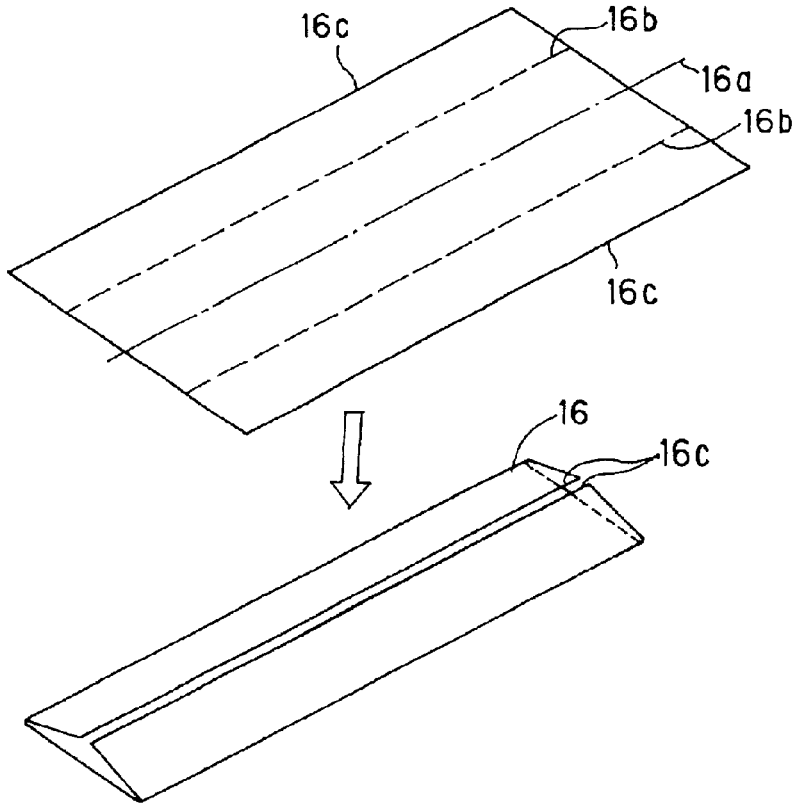
FIG. 5 is a perspective view illustrating another example of a side film.

FIG. 5 illustrates another example of the side film. This side film 16 is formed by tucking in the both ends 16*c* of a rectangular film at a crease 16*b* so that the both ends 16*c* of the film are located on the center line 16*a*.

Figure 6:
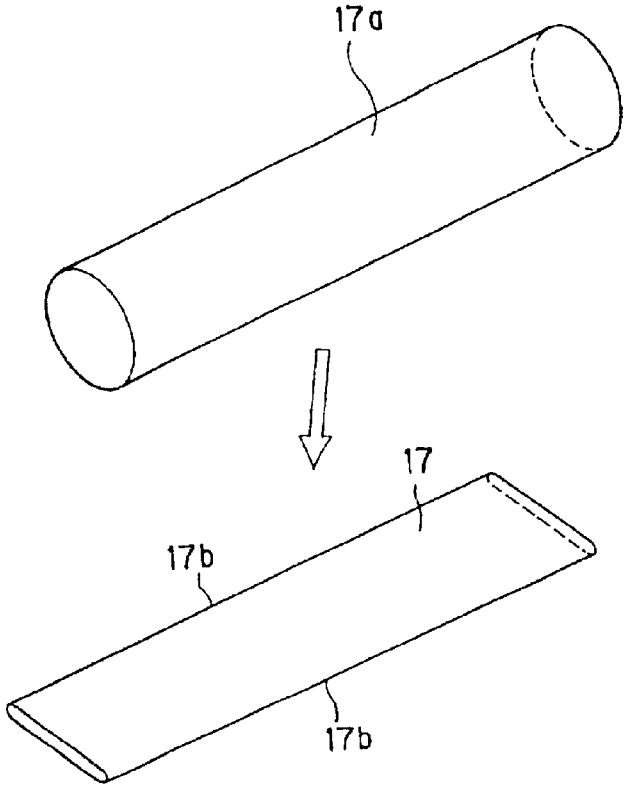
FIG. 6 is a perspective view showing still another example of a side film.

FIG. 6 illustrates still another example of the side film. The side film 17 is formed by crushing a tubular film 17*a* and providing creases 17*b* on the both sides thereof. A seamless cylindrical film manufactured by drawing is applicable as the tubular film 17*a*.

Figure 7:
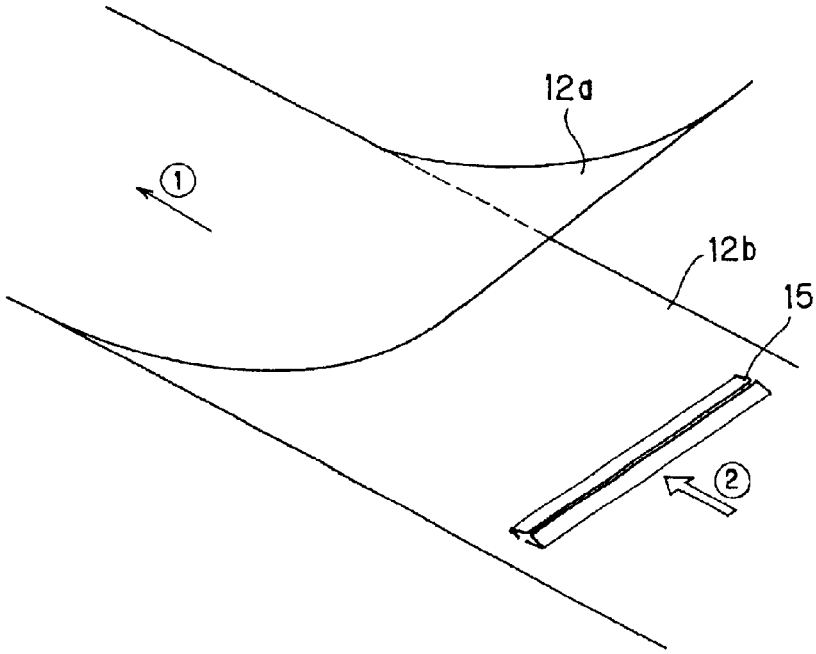
FIG. 7 is a perspective view showing a side film inserted into the flat film.

In the above-mentioned embodiments, the side film 15 is inserted in a direction perpendicular to the transfer direction of the flat films 12*a* and 12*b*. However, the side film 15 may be inserted, as shown in FIG. 7, in the same direction (arrow direction 2 in FIG. 7) as the transfer direction (arrow direction 1 in FIG. 7) of the flat films 12*a* and 12*b*. The side film 15 is not adhered to the lower flat film 12*b*, but may be adhered to the upper flat film 12*a*. Furthermore, when the side film 15 is formed by two V-shaped films 15*a* and 15*b*, the V-shaped films 15*a* and 15*b* may be temporarily adhered to the upper flat film 12*a* and the lower flat film 12*b*, respectively, spaced apart from each other by an appropriate distance so as to form side surfaces 2*c* and 2*d* of the bag main body 2 transferred front and back when placing the pair of flat films 12*a* and 12*b* opposed to each other.

Figure 8:
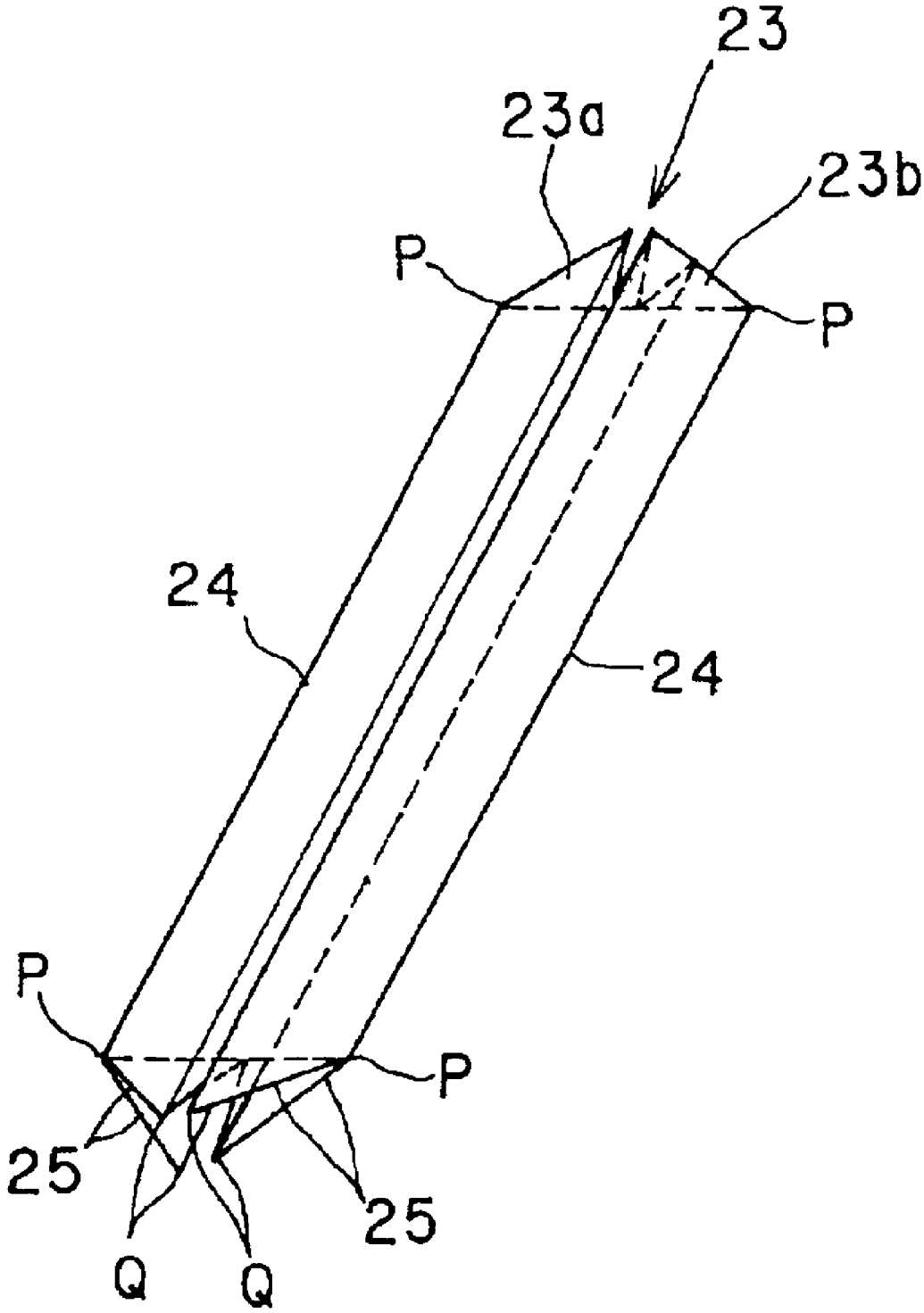
FIG. 8 is a perspective view illustrating a boat-shaped side film.

FIG. 8 illustrates still another example of the side film inserted onto the flat films 12*a* and 12*b*. This side film 23 may be formed by combining boat-shaped films 23*a* and 23*b* prepared by folding a rectangular film at the center line, forming a bottom crease 24, tucking in the film at the crease 24 from a point of the crease selected as a base point P to an end of the film in a direction counter to the original tucking direction, and tucking in the film at lines connecting the two corners Q at ends of the film or the proximity thereof and the base point P in an inward direction of the gusset bag to form a convex edge 25. When forming the side film 23, it is not necessary to fold the side film 23 for forming an open surface on the side film 23.

After insertion onto the flat film 12*b*, the side film 15 is temporarily sealed to the flat film 12*b* by a side film sealing unit 18 such as a sealing bar, as shown in FIG. 3. The upper and lower flat films 12*a* and 12*b* are synchronously placed opposite to each other by a film placing unit 19 such as a placing roll to form a strip-shaped film 20. The flat films 12*a* and 12*b*, and the side film 15 forming this strip-shaped film 20 are sealed again by a side film sealing unit 21 such as a sealing bar.

Figure 9:
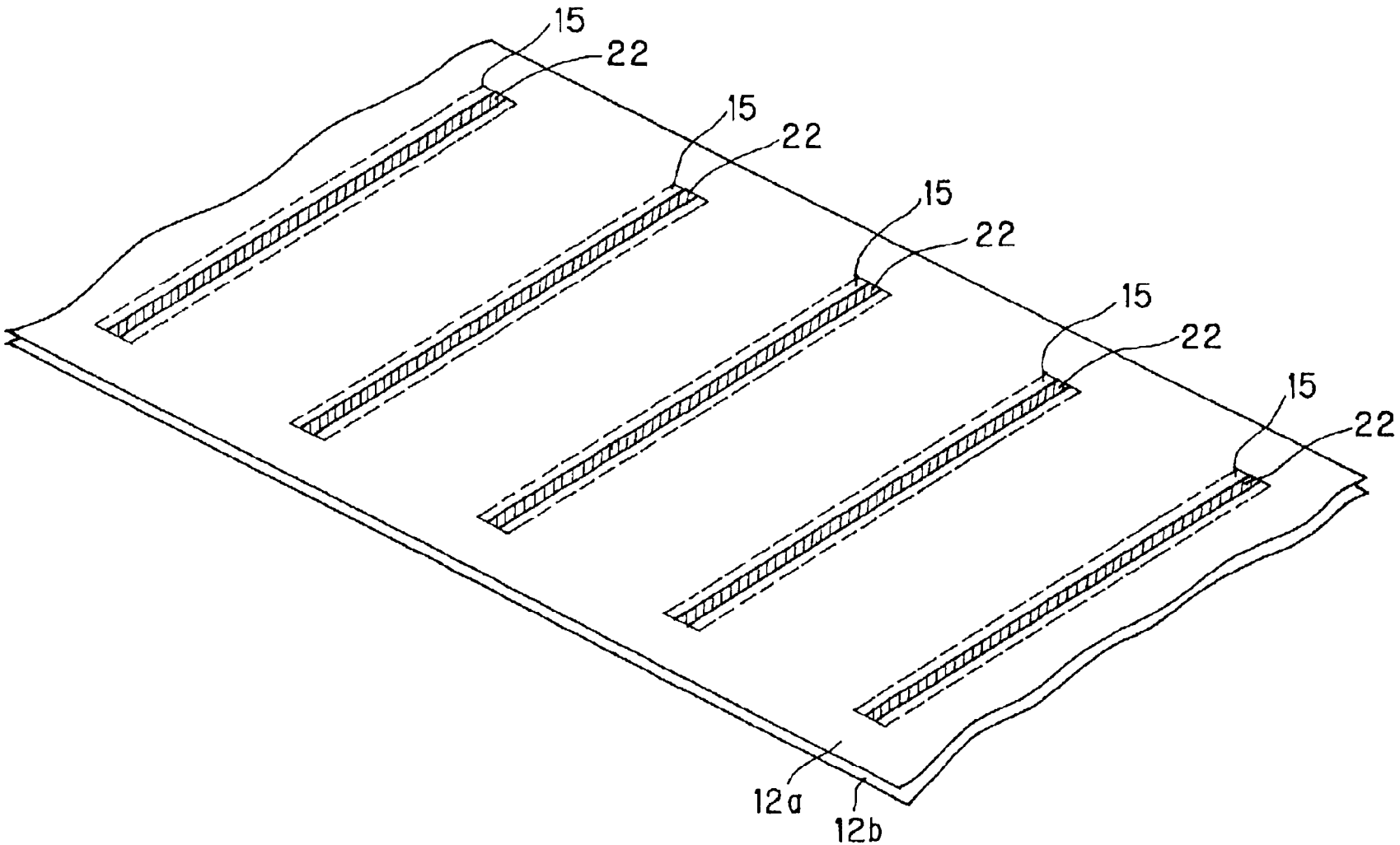
FIG. 9 is a perspective view illustrating sealing of the flat film and the side film.

FIG. 9 illustrates the sealing surface 22 of the side film 15 (FIG. 4) and the flat films 12*a* and 12*b*. In this step, a portion near the center of the side film 15 (the opposed edges of the V-shaped films 15*a* and 15*b*) is sealed over the entire length in the longitudinal direction (hatched portion in FIG. 9) so as to connect the side edges of the flat surfaces 2*a* and 2*b* and the sides 2*c* and 2*d* of the bag main body 2.

Figure 10:
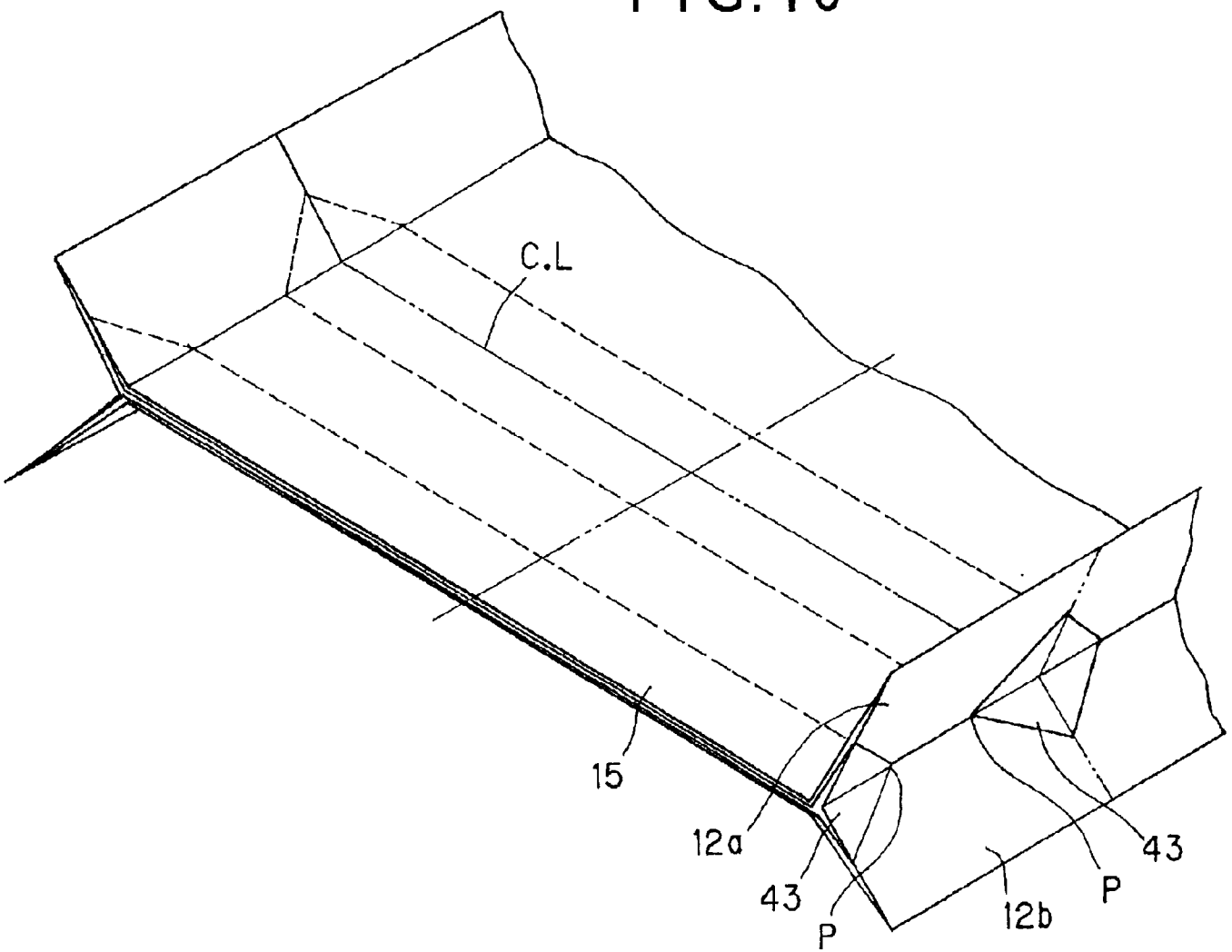
FIG. 10 is a perspective view showing open surfaces formed on the flat film and the side film.

In the next step, as shown in FIG. 3, the right and left ends of the pair of flat films 12*a* and 12*b* are spaced apart by an open surface forming unit 32 to form an open surface 43. In this open surface forming step, the space is vertically expanded by sucking the end of flat films 12*a* and 12*b* by a suction pad of the flat films sequentially transferred. As shown in FIG. 10, open surfaces 43 are formed in the flat films 12*a* and 12*b* and the side film 15 by folding the side film 15 outside at a point of the gore crease as a base point.

Figure 11A:
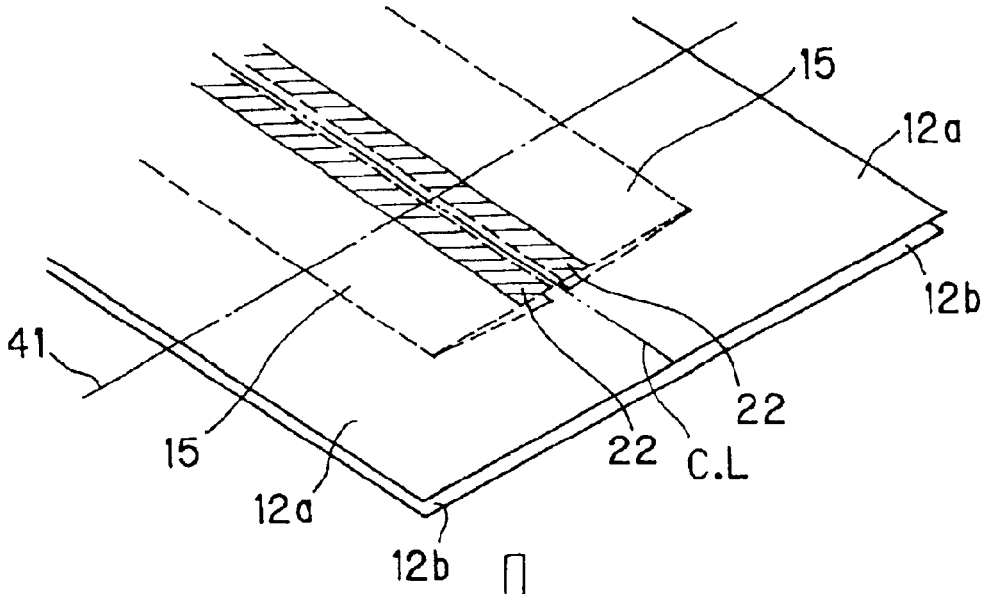
FIG. 11 is a perspective view showing a forming method of an open surface.
Figure 11B:
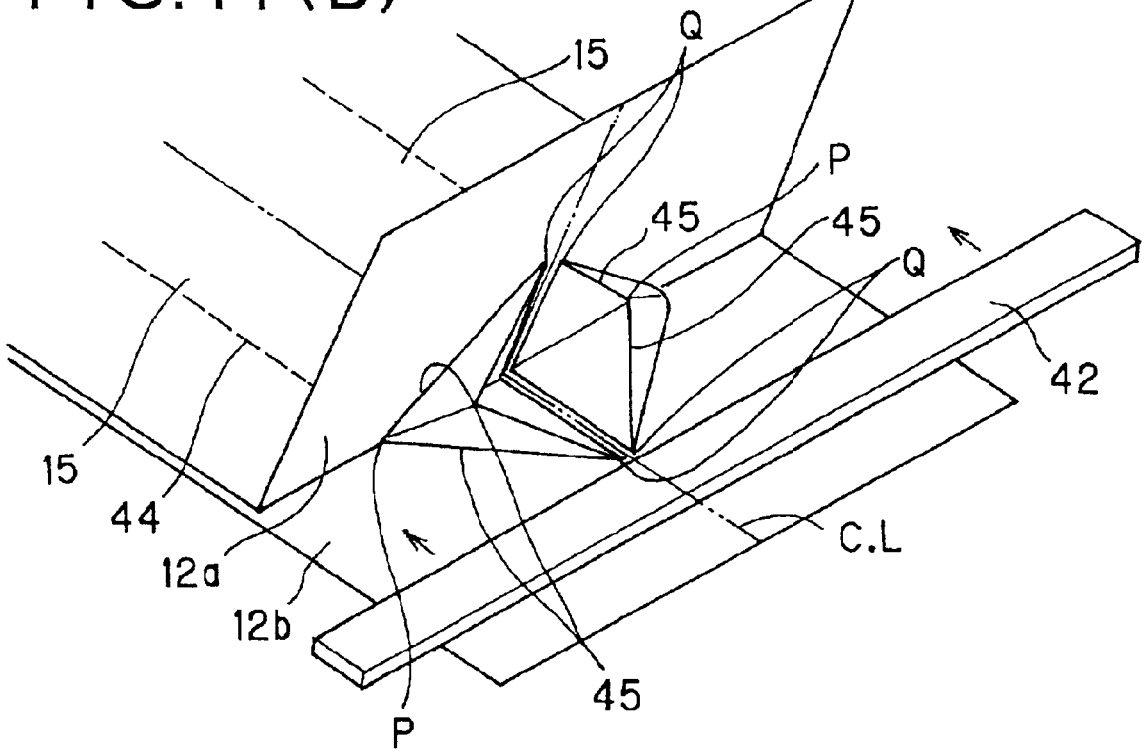

FIG. 11 illustrates a forming method of an open surface. As shown in FIG. 11 (A), by opening the ends of the flat films 12*a* and 12*b* in a state in which an inside portion of the one-point chain line 41 of the flat films 12*a* and 12*b* is pressed by a pressing plate not shown, the side film 15 is gradually folded at a point P on the gore crease as a base point as shown in FIG. 11 (B), because the side film 15 and the flat films 12*a* and 12*b* are sealed over the entire length to form the sealing surfaces 22 (FIG. 11 (A). By inserting a holding plate 42 at the folded portion, the side film 15 is tucked in at the original crease 44 from an arbitrary point of the crease 44 as a base point P to the end of the side film 15, in a direction counter to the original tucking direction, and a convex edge 45 is formed in the inward direction of the bag main body 2 at a line connecting the two corners Q of the ends of the side film and the base point P. Tucking as shown in FIG. 10 is thus accomplished.

Figure 12:
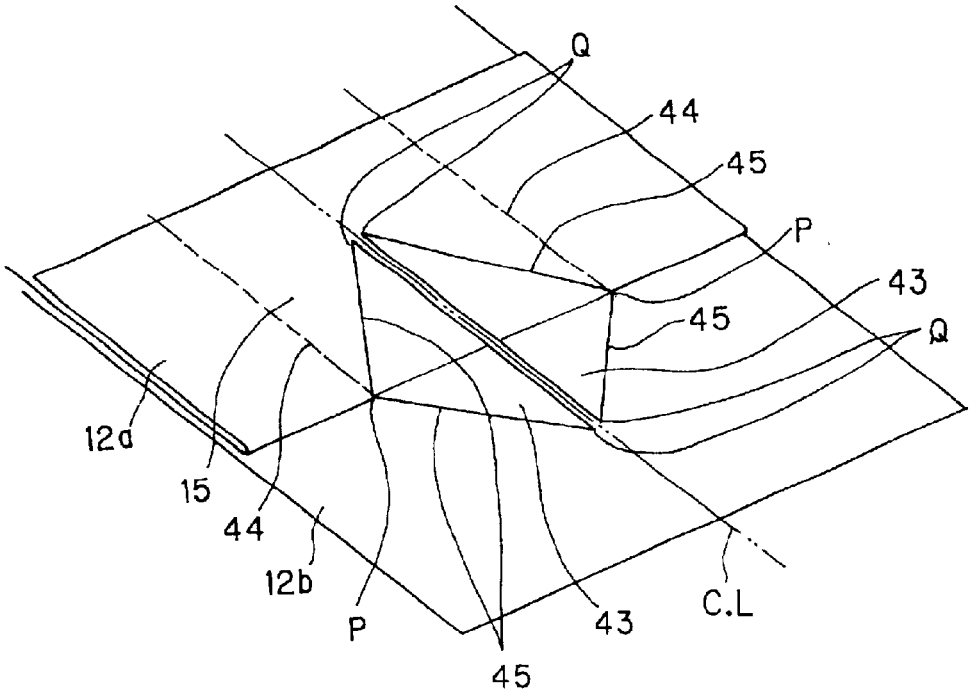
FIG. 12 is a perspective view showing another forming method of an open surface.

FIG. 12 shows another forming method of an open surface. In FIG. 12, one end of the flat film 12*a* is completely turned up the end of the flat film 12*b* without the use of the holding plate 42, and the end portions of the side film 15 are tucked in along a line as a convex edge 45 connecting the two corners Q of the ends of the side film 15 and the base point P in the inward direction of the bag main body 2. Thus, a triangular open surface 43 is formed on the side film 15. By resetting the thus completely opened flat film 12*a*, the side film 15 is tucked in at the original crease 44 extending from the base point P which is an arbitrary point on the crease 44 to the end of the side film 15, in a direction counter to the original tucking direction. A tuck as shown in FIG. 10 is thus formed. A two-point chain line C, L in FIGS. 10, 11 and 12 represents a cutting line described later.

Figure 13:
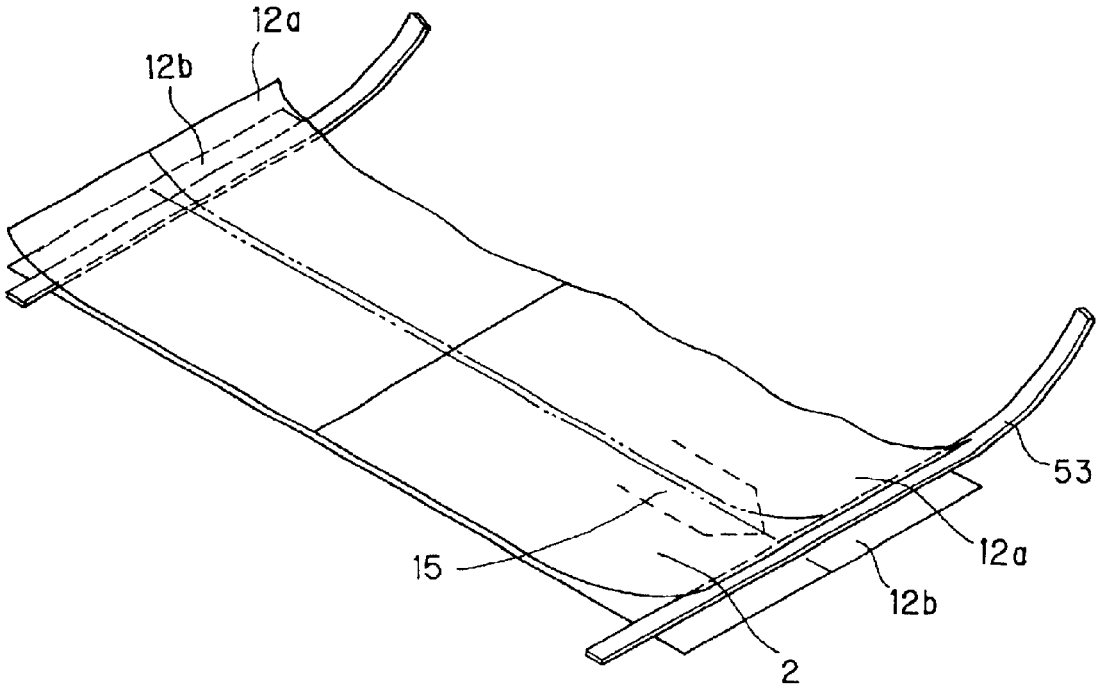
FIG. 13 is a perspective view illustrating an attaching method of a zipper.

In the next step, as shown in FIG. 3, zippers transferred in directions in parallel with the transfer direction of the flat film are attached to the right and left open surfaces by a zipper attaching unit 51. A zipper tape 53 is fed from a reel 52 composing the zipper attaching unit 51. As shown in FIG. 13, the zipper attaching unit 51 feeds this zipper tape 53 between the flat films 12*a* and 12*b*. The zipper tape 53 is sealed on the inner walls of the flat films 12*a* and 12*b*. The zipper tape 53 is held, at an other position of the side film 15, between the open surfaces in a state in which a male member and a female member engage with each other; the male member is fusion-bonded to one of the open surfaces, and the female member, to the other open surface. To make it easy to conduct side sealing of the bag main body 2, the portion of the zipper tape 53 corresponding to the side of the bag main body 2 is flattened by a press.

In the next step, as shown in FIG. 3, the open surfaces formed at the end of the flat films 12*a* and 12*b* are sealed by an open surface sealing unit 61 such as a sealing lever. In this step, the entire area of the top end of the mouth 4 of the bag main body 2, and the sides of the bag main body 2 are side-sealed. Portions of the sides of the bag main body 2 ranging from the upper end of the mouth 4 through the zipper 3 to the end of the side film 15 are sealed.

Figure 14:
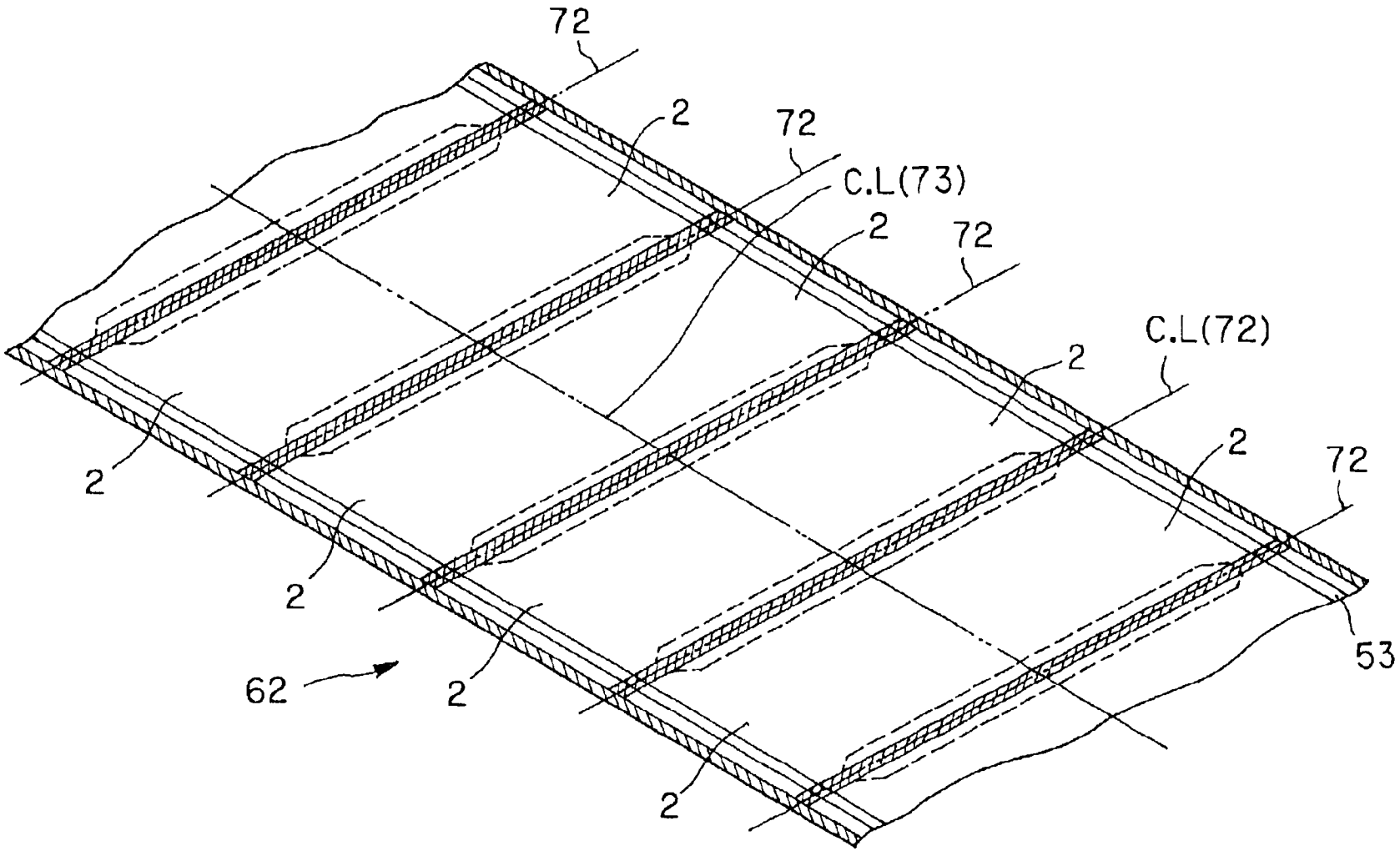
FIG. 14 is a perspective view showing a strip-shaped film immediately before cutting in the case where a zippered gusset bag is formed in a double-face configuration.

FIG. 14 illustrates a strip-shaped film 62 after the completion of the sealing step. The strip-shaped film 62 is formed by continuously connecting the right and left rows of the bag main body combined with the bottom 63. The entire outer edge of the bag main body 2 is sealed through the sealing step of the open surface and the sealing step of the side film, as described above.

In the next step, the strip-shaped film 62 is cut along cutting lines C, L (72, 73) so as to form two right and left rows of wrapping bags by a cutting unit using a laser or the like (see FIG. 3). There is thus available a gusset bag 1 having of a zipper. A manufacturing method of a gusset bag having two right and left rows of zippers will now be described.

Figure 15:
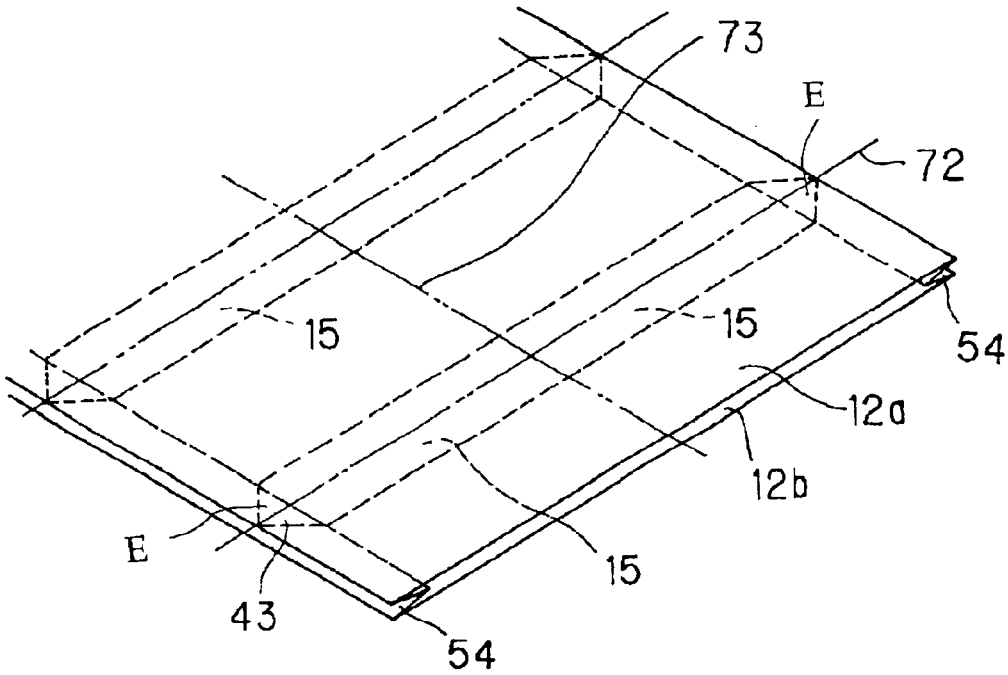
FIG. 15 is a perspective view showing a strip-shaped film immediately before cutting in the case where a gusset bag having a flat bottom is formed in a double-face configuration.

FIG. 15 illustrates a manufacturing method of a gusset bag of the flat bottom type having bottoms of two right and left rows formed flat. In this manufacturing method, the steps up to that of forming the open surface (FIGS. 10, 11 and 12) are the same as in the manufacturing method of the gusset bag having zippers as described above. In this case, the distal ends E of the side film 15 is positioned near the ends of the flat films 12*a* and 12*b*. A step of attaching a V-shaped bottom film 54 to the open surface 43 is provided in place of the step of attaching the zipper 53 to the open surface 43. Subsequently, the bottom film 54 and the flat films 12*a* and 12*b* are sealed. The V-shaped bottom film 54 extends in a direction in parallel with the transfer direction of the flat films 12*a* and 12*b*. The bottom film 54 is inserted into the depth of the open surface 43. By cutting along the prescribed cutting lines 72 and 73, there is available a gusset bag of the flat bottom type having a flat bottom. Along the cutting line 73 is provided an open mouth of the bag 1 which is sealed after it is filled with contents.

Figure 16:
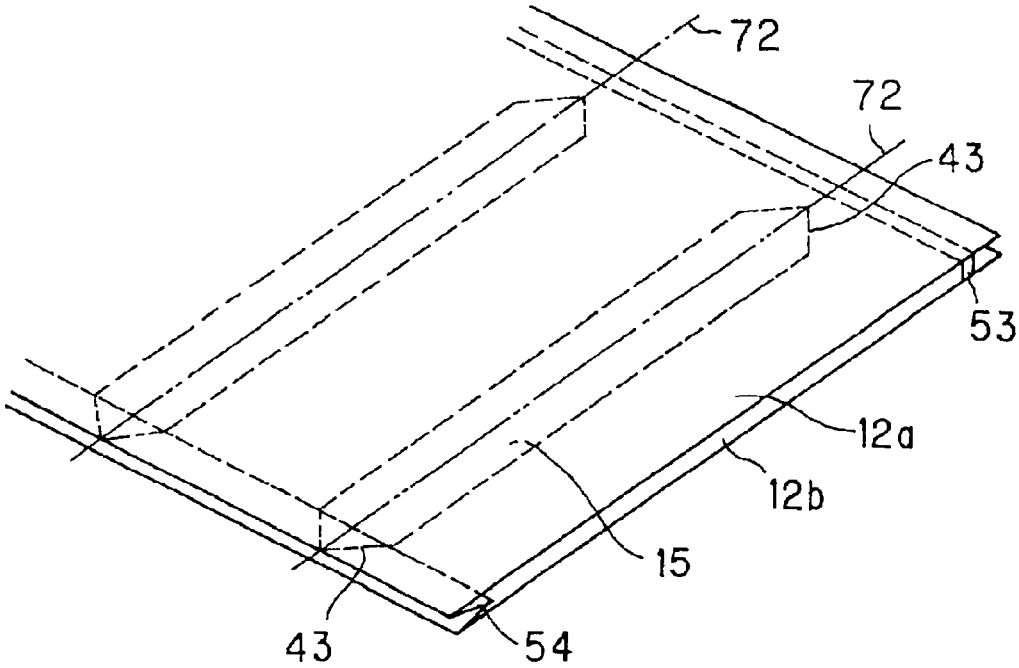
FIG. 16 is a perspective view showing a strip-shaped film immediately before cutting when manufacturing a zippered gusset bag having a flat bottom.

FIG. 16 illustrates a manufacturing method of a gusset bag having a flat bottom and also zippers. In this case, the flat films 12*a* and 12*b* form one row of bags. The steps up to that of forming the open surface 43 in this manufacturing method are the same as in the manufacturing method of the gusset bag having zippers described above. The zipper 53 is attached to one side of the flat films 12*a* and 12*b*, and attaching the V-shaped bottom film 54 is attached to the other side thereof. The zippers 53 and the bottom film 54 extend in the transfer direction of the flat films 12*a* and 12*b*. After attaching the zippers 53 and the bottom film 54, the zippers 53 and the flat films 12*a* and 12*b*, on the one hand, and the bottom film 54 and the flat films 12*a* and 12*b* are sealed. By cutting along a prescribed cutting line 72, there is available a gusset bag having a flat bottom and zippers.

Figure 17:
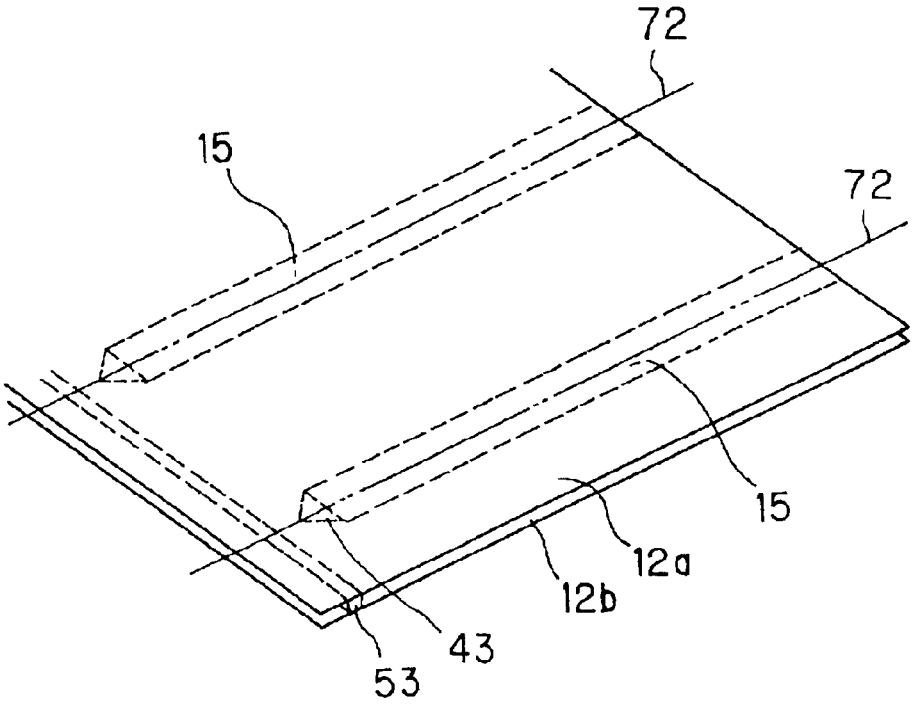
FIG. 17 is a perspective view illustrating a strip-shaped film immediately before cutting when a zippered gusset bag is formed into a single-face configuration.

FIG. 17 illustrates a manufacturing method of a gusset bag having a row of zipper in one row of the bags. This manufacturing method comprises a step of forming the open surface 43 in which an open surface 43 is formed only on one end side of the side film 15. A zipper 53 is attached to one side of the flat films 12*a* and 12*b*, and the zipper 53 and the flat films 12*a* and 12*b* are sealed. By cutting along a prescribed cutting line 72, there is available a gusset bag having a zipper.

Figure 18:
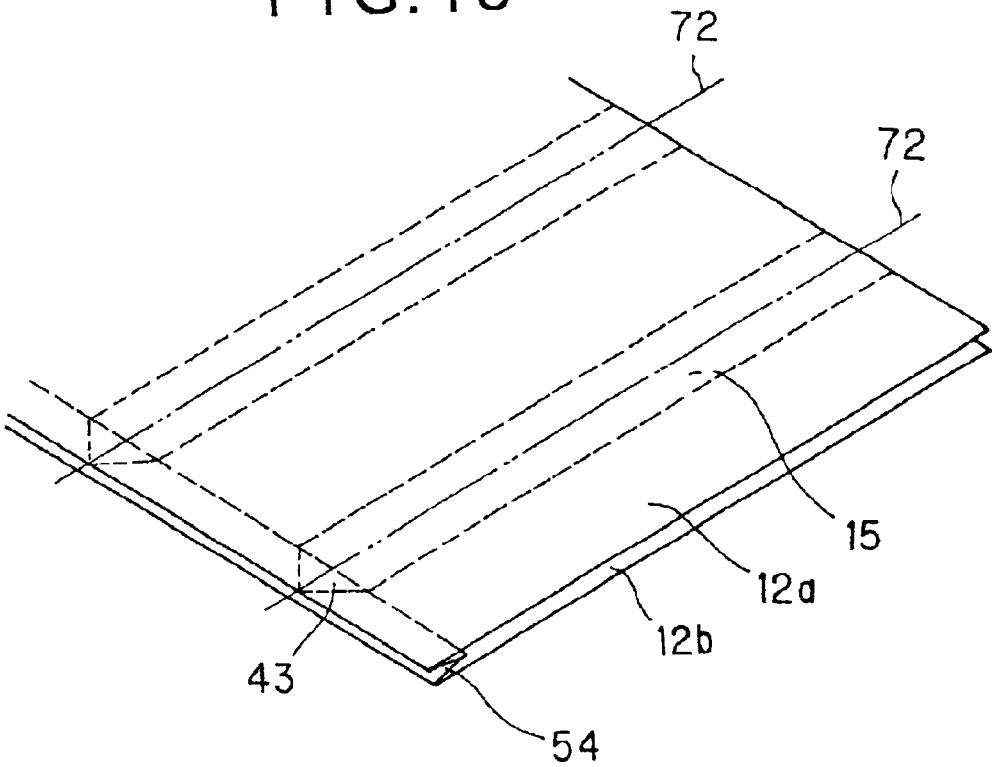
FIG. 18 is a perspective view illustrating a strip-shaped film immediately before cutting when a gusset bag having a flat bottom is formed in a single-face configuration.

FIG. 18 illustrates a manufacturing method of a gusset bag having a row of flat bottom in one row of bags. In this manufacturing method, the open surface 43 is formed only on one end side of the side film 15. The V-shaped bottom film 54 is attached to one of the open surfaces 43, and the bottom film 54 and the flat films 12*a* and 12*b* are sealed. By cutting along a prescribed cutting line 72, there is available a gusset bag having a flat bottom.

In the zippered gusset bag 1 manufactured through the steps described above, after filling the bag with contents (for example, tea leaves, coffee) from respective openings, the openings are sealed to close the interior. Upon charging the contents, the zippered gusset bag 1 expands through expansion of the pleats to a larger thickness, resulting in a box shape.

When opening this zippered gusset bag 1, the bag is cut along the one-point chain line 8 shown in FIG. 1 between the leading end sealed portion and the zipper 3. By releasing sealing by zipper 3, the upper portion of the gusset bag 1 is opened, and the contents can be removed. After removal of the contents, the interior of the gusset bag 1 can be closed again by sealing the zipper 3.

According to the present invention, as described above, the side film extending in a direction perpendicular to the transfer direction of the flat film or in the same direction as the flat films is inserted between the pair of flat films forming the front side and the back side of the gusset bag, and open surfaces are formed by folding the both ends of the side film so as to facilitate attaching of a zipper or a bottom film. This makes it possible: (1) to manufacture a zippered gusset bag if a zipper is attached to the end of the flat films; (2) to manufacture a gusset bag having a flat bottom if the bottom film is attached to the end of the flat films; and (3) to manufacture a zippered gusset bag having a flat bottom, if a zipper is attached to one end of the flat films and a bottom film, to the other end thereof. The manufacturing method capable of coping with the three types of gusset bag is thus available.

What is claimed is:

1. A method of manufacturing a gusset bag having front and back surfaces composed of a pair of flat surfaces opposed to each other and sides composed of pleat-shaped side surfaces connecting the side edges of the pair of flat surfaces and tucked in the pair of flat surfaces, comprising the steps of:

a. transferring a pair of flat films in such a manner that the flat films are opposed to each other in a vertical direction and form the front and back surface of the bag;

b. inserting side films between said pair of flat films so as to extend in a direction perpendicular to the transfer direction of said flat films and forming the side surfaces of said gusset bag, the side films each comprising a combination of V-shaped films opposed to each other;

c. forming a strip-shaped film by placing the pair of flat films opposed to each other;

d. sealing the flat films and the side films;

e. forming an open surface at both ends of the side films and the flat films, forming an open surface made by tucking in each V-shaped side film at a gore crease from a point on the crease selected as a base point to an end of each V-shaped side film in a direction counter to the original crease and forming a convex edge in an inward direction of the gusset bag at a line connecting two corners at the ends of each V-shaped side film or the proximity thereof and said base point to thereby form an open surface at end of each of the side film and the flat film;

f. attaching, to each end of the flat films, a zipper tape or a V-shaped bottom film extending in a direction in parallel with the transfer direction of the flat films;

g. sealing together the zipper tape and/or V-shaped bottom film, the side films and the flat films; and h. cutting the strip-shaped film along a prescribed cutting line located between at least two gusset bags to form the side films as side surfaces of two gusset bags located adjacent each other in front and back in the transfer direction of the strip-shaped film so as to form gusset bags in two rows to the left and right of the prescribed line.

2. A method of manufacturing a gusset bag according to claim 1, wherein at least one end of each side film does not extend to the longitudinal edges of the flat films, said at least one end of each side film is square, and the step of sealing together the zipper tape and/or V-shaped bottom film and the flat films includes sealing the flat films along the longitudinal edges thereof.

3. A method of manufacturing a gusset bag according to claim 1, further comprising the steps of: cutting a material at a center thereof into two halves; and separating the two halves into the pair of upper and lower flat films comprising said pair of flat surfaces before execution of the transferring step (a).

4. A method of manufacturing a gusset bag having front and back surfaces composed of a pair of flat surfaces opposed to each other and sides composed of pleat-shaped side surfaces connecting the side edges of the pair of flat surfaces and tucked in the pair of flat surfaces, comprising the steps of:

a. transferring a pair of flat films in such a manner that the flat films are opposed to each other in a vertical direction and form the front and back surface of the bag;

b. inserting side films between said pair of flat films so as to extend in a direction perpendicular to the transfer direction of said flat films and forming the side surfaces of said gusset bag, the side films being formed before the step of insertion from a pair of boat-shaped films opposed to each other, the boat-shaped films being prepared by folding a rectangular film at a center line, forming a bottom crease, tucking in the film at the crease from a point on the crease selected as a base point to an end of the film in a direction counter to the bottom crease, and tucking in said film at lines connecting two corners at the ends of the film or the proximity thereof and the base point in an inward direction of the gusset bag form a convex edge;

c. forming a strip-shaped film by placing the pair of flat films opposed to each other;

d. sealing the flat films and the side films;

e. forming an open surface at both ends of the side films and the flat films;

f. attaching, to each end of the flat films, a zipper tape or a V-shaped bottom film extending in a direction in parallel with the transfer direction of the flat films;

g. sealing together the zipper tape and/or V-shaped bottom film, the side films and the flat films; and h. cutting the strip-shaped film along a prescribed cutting line located between at least two gusset bags to form the side films as side surfaces of two gusset bags located adjacent each other in front and back in the transfer direction of the flat films, and cutting the strip-shaped film along a prescribed line parallel with the transfer direction of the strip-shaped film so as to form gusset bags in two rows to the left and right of the prescribed line.

5. A method of manufacturing a gusset bag according to claim 4, further comprising the steps of: cutting a material at a center thereof into two halves; and separating the two halves into the pair of upper and lower flat films comprising said pair of flat surfaces before execution of the transferring step (a).

* * * * *